United States Patent [19]

Evans et al.

[11] 4,003,217

[45] Jan. 18, 1977

[54] EARRING CONSTRUCTION

[75] Inventors: Andrew J. Evans, Greenville, R.I.; Ira Nason, Sharon, Mass.

[73] Assignee: E. A. Adams & Son, Inc., Pawtucket, R.I.

[22] Filed: June 3, 1976

[21] Appl. No.: 692,596

[52] U.S. Cl. ..... 63/12; 24/232 R

[51] Int. Cl.[2] ..... A44C 7/00

[58] Field of Search ..... 63/12, 13; 24/232

[56] References Cited

UNITED STATES PATENTS

| | | | |
|---|---|---|---|
| 245,297 | 8/1881 | Heckmann | 63/12 |
| 271,121 | 1/1883 | Riley et al. | 63/12 |
| 271,122 | 1/1883 | Riley et al. | 63/12 |
| 2,769,322 | 11/1956 | Czuch | 63/12 |

*Primary Examiner*—F. Barry Shay
*Attorney, Agent, or Firm*—Max Schwartz

[57] ABSTRACT

An earring construction for a pierced ear in which the earring is provided with a gap for receiving the ear lobe. The pin or ear wire which passes through the ear lobe and bridges the gap is provided at one end with a ball. The ball may be integral with the pin or wire. The ball is so mounted in the end of the earring that it allows the pin or ear wire to be swiveled in any direction as in a universal joint. The wearer can then push the pin or wire into the most comfortable position or angle for insertion through the ear lobe. The other end of the earring is provided with a slot at the bottom for receiving the end of the pin or wire. The universal mounting can be incorporated in a small finding consisting of a small socket or round member in which the ball end of the pin is mounted. This provides a ball and joint assembly which can be cast or molded in the end of a cast or molded earring. By embedding the preformed assembly, further assembly operations are eliminated.

9 Claims, 6 Drawing Figures

EARRING CONSTRUCTION

BACKGROUND OF THE INVENTION

In pierced type earrings, the major problem in the construction and mounting of the pin or ear wire which pierces the ear lobe is in its limited scope of movement. Sliding and spring mounted constructions have been tried. In some cases, pivot pins have been used to pivot the pin or wire at one end of the gap to swing across to the other end. U.S. Pat. No. 3,575,013 shows such a pivotal construction. In Pat. Nos. 271,121 and 271,122, the end of the pin is provided with a ball-shaped enlargement which is pivotally mounted in the end of the earring. Such pivotal mountings are difficult to assemble, especially in the small sized earrings. Furhtermore, the connection only allows the pin to swing in one plane. In some constructions this makes it awkward for the wearer to mount the earring on the ear.

SUMMARY OF THE INVENTION

The present invention provides a simple and easily assembled construction which allows the pin or ear wire to swing in any direction as in a universal joint. The end of the pin or ear wire is provided with a ball, which may be integral therewith. One end of the earring is tubular or hollow and the ball is mounted just inside of the open end. The earring is crimped or indented on each side of the diameter of the ball to lock it against lateral movement but to permit swiveling. This acts as a ball and socket or universal joint, allowing the pin to be swung into any desired position. The otherend of the earring, either solid or hollow, is provided with a slot at the bottom to received the end of the pin or ear wire after insertion through the ear lobe.

The above construction can be provided in a separate unit which can be embedded, molded into, cast into, or otherwise mounted on the earring. The ball can be mounted in a suitable socket to provide a universal joint and the socket can then be attached to or embedded in the earring by molding or casting. Further assembly opperations are thus eliminated.

DESCRIPTION OF THE INVENTION

Figure 1:
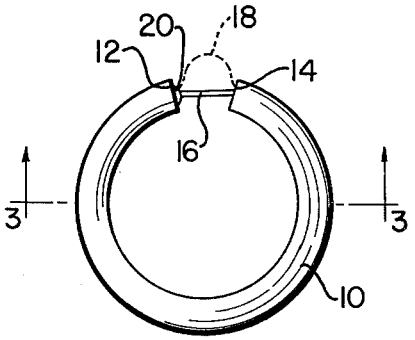
FIG. 1 is a front view of an earring embodying our present invention.

The present invention is particularly concerned with the mounting of the pin or ear wire which passes through the ear lobe on a pierced ear earring. For illustrative purposes only, the earring has been shown as a simple hoop made of a hollow tube. Other designs, shapes or construction can be used. It is only necessary to provide room at one end of the earring for the mounting hereinafter described, Referring more in detail to the drawings, the earring 10 is illustrated as a hollow tube having spaced ends 12 and 14 which form the gap in which the ear lobe is inserted. In mounting the earring, a securing means comprising either a straight pin, such as the pin 16, can be used to pass through the ear lobe opening, or a conventional inverted U-shaped ear wire, such as the wire 18 shown in dotted lines in FIG. 1, can be used. In either case, one end of the pin or wire is provided with a ball 20 which may be integral with it.

Figure 3:
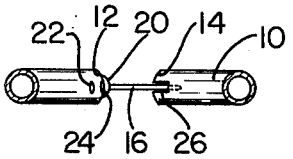
FIG. 3 is a section taken on line 3-3 on FIG. 1.
Figure 4:
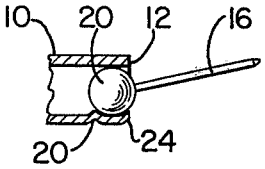
FIG. 4 is a fragmentary section showing the ball mounting on the end of the earring.

The ball 20 is of a diameter to fit easily into the end 12 of the earring. As can be seen in FIGS. 3 and 4, the body of the earring is provided in the bottom thereof with dents or crimps 22 and 24 one on each side of the diameter of the ball 20. This locks the ball 20 against longitudinal movement but allows it to swivel.

The other end of the earring, 14, is provided with a slot 26 on the underneath part, see FIG. 3. The pin or ear wire 16 or 18 will bridge the gap and its free end will enter the slot 26 into the end of the earring. The slot 26 can also be positioned at one side if desired.

Figure 2:
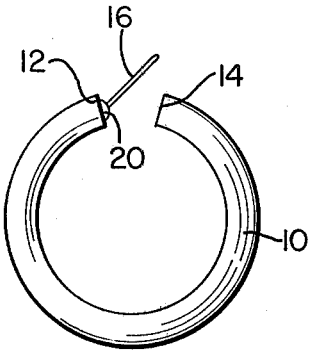
FIG. 2 is a view similar to FIG. 1 with the pin in open position.

The wearer thus swings the pin 16 into a comfortable position for insertion in the ear lobe as shown in FIG. 2. This can be straight up or to one side or at an angle, the ball joint permitting free swinging movement of the pin. After insertion, the pin or wire is pulled down at the other end of the earring and pushed through the slot. Since the weight of the earring pulls it downwardly, the pin will not accidently slip out of the slot.

The above construction thus eliminates all slow and costly assembly operations associated with a pivot pin. In some designs the earring is very tiny, barely fitting around the ear lobe. To insert a pivot pin in such a construction is a slow and costly assembly operation.

The above construction can also be readily applied to wooden, metal, plastic, or any other earring materials. In such cases, the pin or ear wire is initially assembled with a suitable socket which is then separately mounted on the earring. Such a construction is shown FIGS. 5 and 6.

Figure 5:
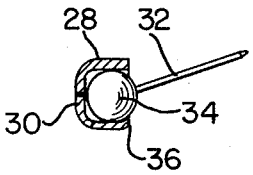
FIG. 5 is a view similar to FIG. 4 showing the ball mounted in a separate socket.

Referring to FIG. 5, a short socket member 28 is formed with an open front end and a closed rear 30. The socket 28 corresponds to the end of the earring shown in FIG. 1 cut short. The pin 32 is provided with the ball 34 as in the first form. The front of the socket member 28 is then drawn down at 36 to lock the ball in the cup-shaped socket 28. In use, the socket 28 is molded or cast directly into the end of the earring. The operation is the same as in FIG. 1, a slot being provided in the other end to receive the pin. Instead of molding or casting, this separate construction allows other forms of assembly. For example, the socket may be soldered to the earring, or embeedded in a preformed opening, etc.

Figure 6:
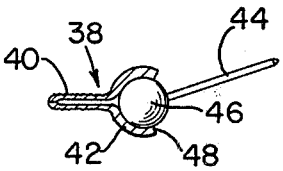
FIG. 6 is a view similar to FIG. 5 showing a separate ball joint mounting.

FIG. 6 illustrates a more sophisticated version of the construction shown in FIG. 5. A rivet 38 is provided with the conventional shank 40 and a cup-shaped head 42. The pin or wire 44 is provided with the ball 46. The ball is positioned in the cup 42 and the edges are rolled over it at 48 to lock the ball 46 in place. This construction forms a ball joint which allows for universal swiveling movement of the pin or wire 44. At the rear, the integral shank 40 is crimped or roughened so that when it is sunk into a cast or molded earring, it will anchor in place.

It may be found necessary to tighten the mounting of the ball in its socket to provide a frictional drag. This will allow the pin to remain the angular position into which it is pushed. Various mechanical constructions may be used. In the form shown in FIG. 1 the tubular earring is seamed. Therefore, if the ball has a slightly larger diameter than the inner diameter of the tube, the tube will spread slightly to permit the insertion of the ball, but will hold it tight to provide a drag. In the other forms, such as shown in FIG. 6, the socket portion can be slotted in a tight fit so that there is sufficient give to mount the ball but sufficient grip to provide a friction drag. Any other friction drag construction can readily be used.

We have thus provided an earring construction which eliminates slow and costly assembly operation and allows the wearer to move the pin or wire in any direction or angle for easy and comfortable insertion in the ear lobe. The construction lends itself to the preparation of a separate finding for adding the construction independantly to the earring.

Other advantages of the present invention will be readily apparent to a person skilled in the art.

We claim:

1. An earring for a pierced ear having spaced aligned ends forming a gap for the insertion of an ear lobe, securing means adapted to pass through the ear lobe opening and bridge said gap to mount the earring on the ear, means for mounting one end of said securing means in one end of said earring, said mounting means permitting universal swiveling movement of said securing means, and means for positioning and for holding a free end of said securing means in the opposite end of said earring after the insertion of said securing means through the ear lobe.

2. An earring as in claim 1, wherein said securing means is a pin and said mounting means includes a ball at the mounting end of said pin, said ball being mounted in said one end of said earring, said positioning means comprising a slot in the bottom of the opposite end of said earring, said free end of said pin entering said slot.

3. An earring as in claim 2, wherein said ball is integral with said pin.

4. An earring as in claim 2, wherein said mounting means further comprises a dent in the bottom of said earring on each side of said ball.

5. An earring as in claim 2, wherein said mounting means further comprises a hemispherical socket, said ball being locked in said socket to provide a ball and socket joint, said socket being mounted in said one end of said earring.

6. An earring as in claim 4, wherein said ball and dented portion of said earring end are separately assembled and mounted on the end of the earring.

7. An earring as in claim 5, wherein said ball and socket are separately assembled and mounted on the end of the earring.

8. An earring as in claim 4, wherein said ball is integral with said pin.

9. An earring as in claim 5, wherein said ball is integral with said pin.

* * * * *